United States Patent [19]

Okamura et al.

[11] Patent Number: 5,042,364

[45] Date of Patent: Aug. 27, 1991

[54] PISTON STRUCTURE FOR INTERNAL COMBUSTION ENGINE

[75] Inventors: Eiji Okamura; Hiroyuki Watanabe; Hirofumi Kato; Hisakazu Muta, all of Kanagawa, Japan

[73] Assignee: Atsugi Motor Parts Company, Limited, Kanagawa, Japan

[21] Appl. No.: 359,707

[22] Filed: May 31, 1989

[30] Foreign Application Priority Data

May 31, 1988 [JP] Japan ..... 63-72471
Jun. 17, 1988 [JP] Japan ..... 63-80171

[51] Int. Cl.[5] ..... F01B 31/08

[52] U.S. Cl. ..... 92/186; 92/208; 92/222; 92/177; 92/233; 92/234; 123/193 P; 29/888.046

[58] Field of Search ..... 92/153, 158, 160, 163, 92/186, 209, 212, 222, 224, 233, 234, 248, 177, 225, 226, 227, 228, 229; 123/193 P; 29/156.5 R, 888.04, 888.046

[56] References Cited

U.S. PATENT DOCUMENTS

| | | | |
|---|---|---|---|
| 2,506,811 | 5/1950 | Rodger | 92/233 |
| 3,709,109 | 1/1973 | Howe | 92/186 |
| 4,318,438 | 3/1982 | Ban et al. | 164/97 |
| 4,336,077 | 6/1982 | Leach et al. | 92/222 |
| 4,648,308 | 3/1987 | Matsui et al. | 92/212 |
| 4,667,627 | 5/1987 | Matsui et al. | 92/212 |
| 4,672,931 | 6/1987 | Biagini | 123/655 |
| 4,694,735 | 9/1987 | Tatematsu et al. | 92/209 |
| 4,830,932 | 5/1989 | Donomoto et al. | 92/222 |
| 4,831,918 | 5/1989 | Mielke et al. | 92/222 |
| 4,868,067 | 9/1989 | Fujisawa et al. | 123/193 P |

FOREIGN PATENT DOCUMENTS

| | | |
|---|---|---|
| 2743350 | 4/1979 | Fed. Rep. of Germany . |
| 3321212 | 12/1984 | Fed. Rep. of Germany . |
| 3639806 | 5/1988 | Fed. Rep. of Germany . |
| 235121 | 4/1958 | German Democratic Rep. . |
| 91162 | 7/1972 | German Democratic Rep. . |

OTHER PUBLICATIONS

*Mechanical Metallurgy,* George Dieter, 12/76, pp. 66–70.

*Primary Examiner*—Edward K. Look
*Assistant Examiner*—Thomas Denion
*Attorney, Agent, or Firm*—Bachman & LaPointe

[57] ABSTRACT

A piston structure includes protection of the peripheral edge portion of a lubricant injection nozzle receptacle cut-out. The piston structure employs mechanisms for reinforcing the peripheral edge portion of the cut-out to an extent that can avoid concentration of the stress and thus can avoid the formation of cracks.

9 Claims, 4 Drawing Sheets

PISTON STRUCTURE FOR INTERNAL COMBUSTION ENGINE

BACKGROUND OF THE INVENTION

1. Field of the Invention

The present invention relates generally to a piston structure for such a type of internal combustion engine. More particularly, the invention relates to a piston structure for such a type of internal combustion engine which has a lubrication system injecting lubricant into internal space of an engine cylinder via a lubricant injection nozzle.

2. Description of the Background Art

Japanese Utility Model First (unexamined) Publication (Jikkai) Showa 57-89812 discloses a lubrication system for a piston of an internal combustion engine. The disclosed lubrication system has a lubricant injection nozzle projecting into the internal space of an engine cylinder in order to supply lubricant into the internal space of the engine cylinder. The lubricant injection nozzle is placed at higher position to the orientation where the lower edge of a skirt portion of the piston is placed at bottom-dead-center (BDC).

In order to permit the piston to stroke to BDC, a cut-out is formed in the lower edge of the skirt of the piston for receiving the lubricant injection nozzle while the piston is in a position in the vicinity of BDC. Such a piston construction avoids the necessity of extra height of the engine cylinder for providing the lubricant injection nozzle and permits a reduction in the overall height of the engine cylinder block. However, on the other hand, such construction of piston with the cut-out inevitably forms thin portion around the cut-out. Such thin portion tends to cause concentration of stress resulting in formation of crack for damaging the piston.

SUMMARY OF THE INVENTION

Therefore, it is an object of the present invention to provide an improved structure of a piston for an internal combustion engine, which is free from the drawbacks encountered in the prior art.

Another object of the invention is to provide a piston structure including protection of the peripheral edge portion of a lubricant injection nozzle receptacle cut-out.

In order to accomplish the aforementioned and other objects, a piston structure, according to the present invention, employs means for reinforcing the peripheral edge portion of the cut-out in the extent that can avoid concentration of the stress and thus can avoid formation of crack.

According to one aspect of the invention, piston structure for an internal combustion engine which has a lubricant injection nozzle for injecting lubricant into a cylinder bore, comprises:

a piston body having a lower skirt section;

means for defining a cut-out in the lower end portion of said skirt section for receiving said lubricant injection nozzle in a piston position in the vicinity of bottom-dead-center; and means for providing reinforcement for at least the circumferential portion of said cut-out for avoiding concentration of stress in a portion around said cut-out.

The reinforcement is provided by a thicker section extending along the periphery of said cut-out and having a thicker wall thickness than remaining portion of said skirt section.

According to one embodiment, the reinforcement comprises a fiber reinforced core provided in a portion of said skirt section, in which said cut-out is defined. The fiber reinforced core is integrated with remaining skirt section by way of internal chill. Preferably, the fiber reinforced core is formed of fiber reinforced aluminum type composition. The fiber reinforced core is formed of alumina-silicate fiber composition.

The core may be formed by aggregating alumina-silicate fiber composition in a predetermined bulk density and by preforming into a desired configuration.

Alternatively, the reinforcement comprises a pre-formed block formed of a material having higher strength than a material forming major part of said piston body. The pre-formed block is formed of Al-Cu type alloy and the major part of said piston body is formed of Al-Si type alloy. In practice, the pre-formed block may be integrated with said major part of said piston block by way of internal chill. In the alternative, the pre-formed block is integrated with said major part of said piston block by way of welding.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
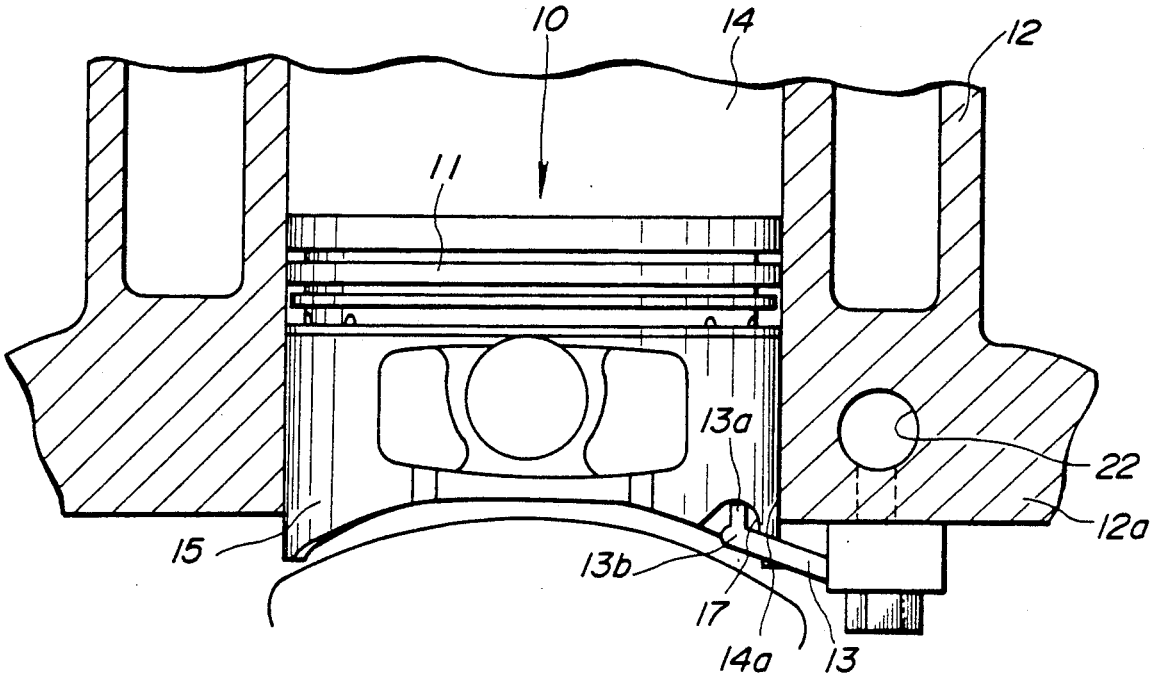
FIG. 1 is a front elevation of the first embodiment of a piston structure according to the present invention.

Referring now to the drawings, particularly to FIGS. 1 through 4, the first embodiment of a piston structure 10 is applicable for a gasoline engine with a turbocharger. The piston structure 10 comprises a piston body 11 made of aluminium alloy. The piston 11 is reciprocally disposed within a cylinder bore 14 of a cylinder block 12. A lubricant injection nozzle 13 is secured on the lower deck 12*a* of the cylinder block 12 in the vicinity of the lower end 14*a* of the cylinder bore 14. The lubricant injection nozzle 13 has an injection outlet 13*a* oriented within the cylinder bore 12*b* and directed upwardly for injecting lubricant toward the piston body 11.

The piston body 11 has a lower skirt section 15. A lubricant injection nozzle receptacle cut-out 17 is formed in the lower edge of the skirt section 15. The cut-out 17 is formed with an essentially arc shaped configuration, and is positioned in the vicinity of one of the pin-bosses 16. The cut-out is further oriented to receive the nozzle 13 at the piston stroke piston in the vicinity of the bottom-dead center (BDC).

Figure 2:
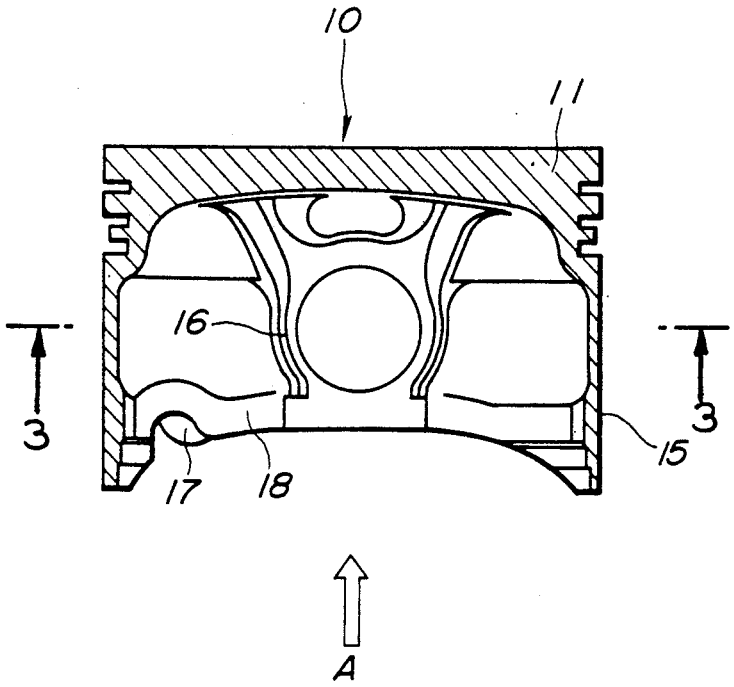
FIG. 2 is a section of a piston in the piston structure of FIG. 1.
Figure 3:
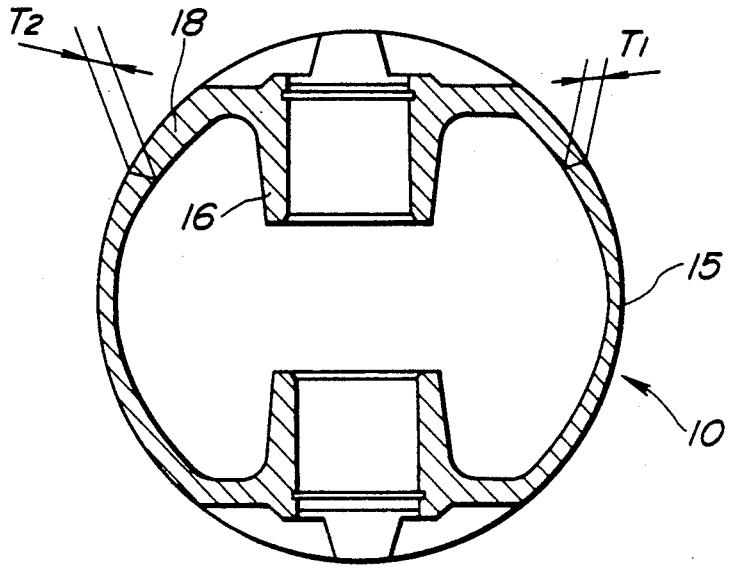
FIG. 3 is a cross-section taken along line 3—3 of FIG. 2.
Figure 4:
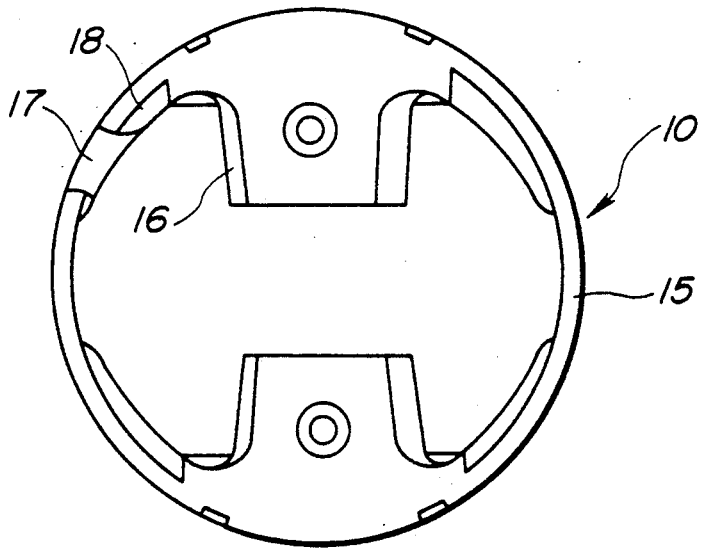
FIG. 4 is a bottom view of the piston of FIG. 2 as viewed along an arrow A in FIG. 2.

As shown in FIGS. 2 through 4, a thicker section 18 having thicker wall thickness $T_2$ is formed in the vicinity of the cut-out 17, which is thicker than the wall thickness $T_1$ of the general section. This thicker section 18 serves for providing reinforcement for the lower end portion of the skirt section 15 around the cut-out 17.

In the shown embodiment, the piston body 11 can be effectively cooled by the lubricant injected through the nozzle 13. In addition, as in the prior art, the presence of the cut-out 17 in the lower edge of the skirt section 15 of the piston, allows the piston to stroke to BDC without causing interference between the lower edge of the skirt section and the nozzle 13. Therefore, it becomes possible to shorten the axial length of the cylinder bore for obtaining necessary piston stroke. This allows one to reduce the overall height of the engine cylinder block. In addition, according to the shown embodiment, since the stiffness of the portion where the thicker section 18 is provided, is increased so as to provide sufficient resistance against lateral thrust. Therefore, concentration of stress around the peripheral edge portion of the cut-out 17 can be successfully avoided. Avoidance of concentration of stress at the portion where the cut-out is formed, successfully eliminates the possibility of forming a crack.

Figure 5:
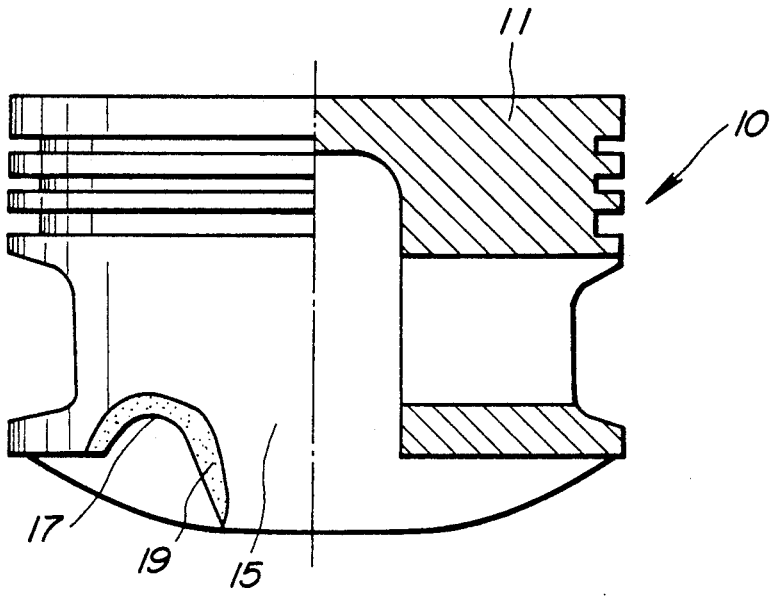
FIG. 5 is a partial section of the second embodiment of a piston according to the invention.
Figure 6:
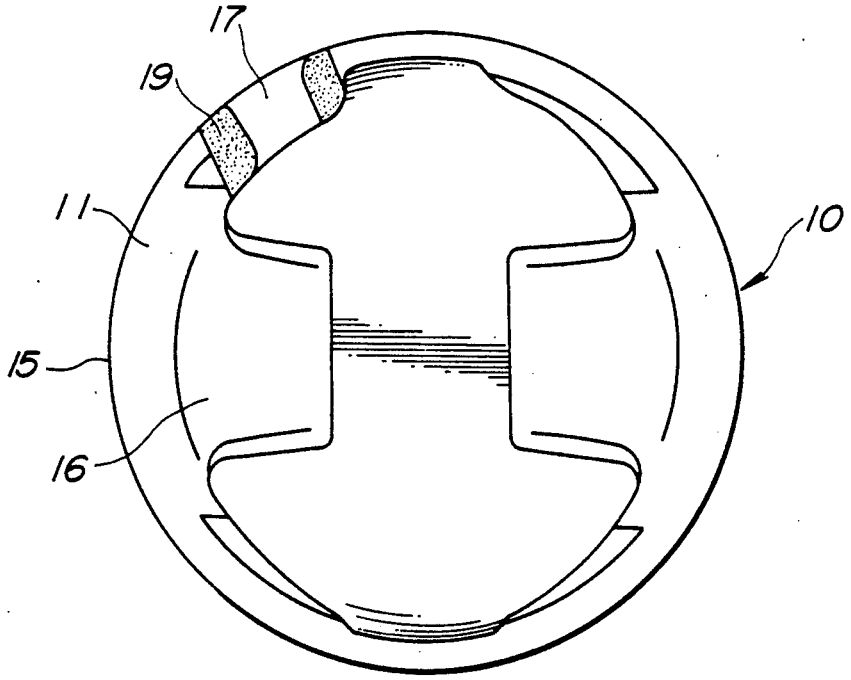
FIG. 6 is a bottom view of the piston of FIG. 5.

FIGS. 5 and 6 show the second embodiment of the piston structure according to the present invention. In this embodiment, the common components or common parts to the former embodiment will be represented by the same reference numerals as in the former embodiment.

In the shown embodiment, a reinforcement 19 is formed of a fiber reinforced composition. For example, the composition useful for forming the reinforcement is formed of alumina-silicate fiber composition which is composed of the following materials and compositions:

$Al_2O_3$: 95 Wt %

$SiO_2$: 5 Wt %

The alumina-silicate fiber composition is aggregated in bulk-density of 0.7 g/cc. The fiber composition set forth above is pre-formed into a cylindrical configuration for forming the core of the reinforcement 19. The pre-formed core is placed within a casting mold. To this casting mold, aluminum alloy (AC8A) as matrix is supplied for performing high pressure casting. Through this process, the reinforcement 19 of the fiber reinforced composition can be formed integrally with the remainder sections.

Similarly to the foregoing embodiment, the reinforcement 19 provides sufficient stiffness for the portion of the skirt section 15 where the cut-out 17 is formed. Therefore, sufficient resistance against lateral thrust is created for avoiding concentration of stress. In addition, since the shown embodiment does not require partial variation of the thickness, better weight balance can be provided. Furthermore, in accordance with the process of production of the piston body 11 with the reinforcement 19 is performed by placing the pre-formed core of fiber composition, uniform bulk-density in the reinforcement can be obtained. Such process is advantageously used for better workability in production.

Figure 7:
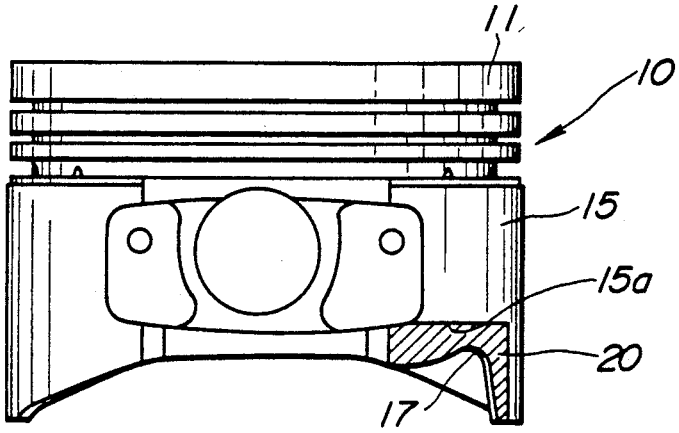
FIG. 7 is a partially sectioned front elevation of the third embodiment of a piston according to the invention.

FIG. 7 shows the third embodiment of a piston structure according to the invention. In this embodiment, essentially quadrate cut-out 15*a* which is sized much greater than the size of the lubricant injection nozzle receptacle cut-out 17, is formed in the skirt section 15 of the piston body 11. A cut-out defining block 21 defining the lubricant injection nozzle receptacle cut-out 17 is formed separately from the piston body. The configuration of the cut-out defining block 20 is in conformance with the quadrate cut-out 15*a* formed in the skirt section 15 of the piston body.

The material for forming the cut-out defining block 20 is selected among ferric or ferro-alloy material containing Ni-resist as principal component, or, in the alternative, titanium alloy and so forth. In the essense, the material to form the cut-out defining block 20 has to have a property of light weight and high strength. The cut-out defining block 20 is combined with the piston body 11 for forming an integral block by way of internal chill. Namely, the cut-out defining block 20 is formed in advance of casting the piston body 11. The block 20 is placed in the desired position in the casting mold. Thereafter, the melt of the aluminium alloy forming the piston body is supplied for forming integral piston body cast block.

In this construction, since the cut-out defining block 20 is made of light weight and high strength material, the internally chilled cut-out defining block serves as reinforcement. Because of high strength of the cut-out defining block 20, the portion of the skirt section 15 where the cut-out 17 is formed can be successfully protected from concentration of stress. Furthermore, since the shown embodiment utilizing pre-formed block 20 in casting and forms the integral cast block by internal chill, high production ability can be provided.

It should be noted that, though the shown embodiment forms the integral block with internally chilled cut-out defining block 20, it is not essential to integrate the cut-out defining block with the piston body. In case, the cut-out defining body 20 and the piston body 11 are formed separately, these blocks may be rigidly connected by welding, for example.

Figure 8:
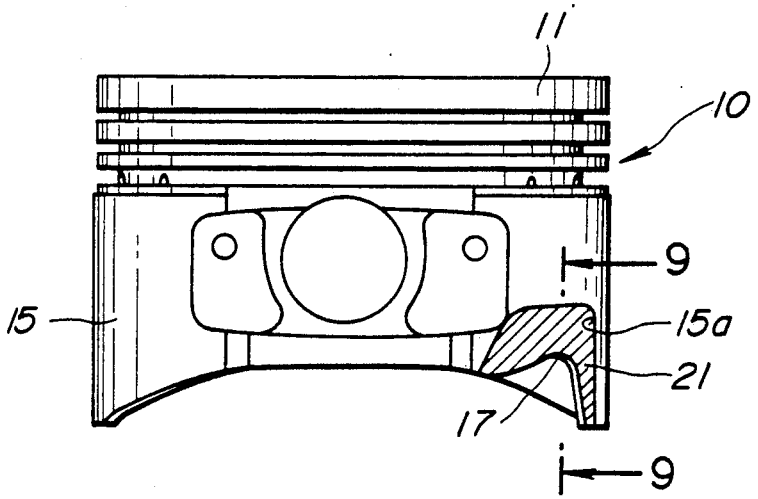
FIG. 8 is a partially sectioned front elevation of the fourth embodiment of a piston according to the invention.
Figure 9:
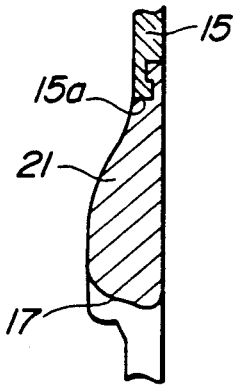
FIG. 9 is a section taken along line 9—9 of FIG. 8.

FIGS. 8 and 9 show the fourth embodiment of a piston structure, according to the invention. In this embodiment, the piston body 11 is formed of Al-Si type alloy. Similarly to the foregoing third embodiment, essentially quadrate cut-out 15*a* is formed in the lower end portion of the skirt 15 of the piston body 11. A cut-out defining block 21 which is formed into a configuration conforming the quadrate cut-out 15*a*, is formed of Al-Cu type alloy. The cut-out defining block 21 is formed with the essentially arc shaped cut-out 17.

Figure 10:
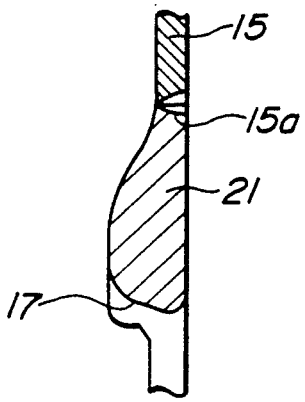
FIG. 10 is a section showing modification of the construction of FIG. 9.

Similarly to the foregoing embodiment, the cut-out defining block 21 is connected to the piston body 11 by internal chill as shown in FIG. 9. In the alternative, as shown in FIG. 10, the cut-out defining block 21 can be connected to the piston block 11 by welding.

In either case, the equivalent advantages as that can be achieved in the former embodiments can be obtained in this fourth embodiment. In addition, by forming the cut-out defining block 21 of Al-Cu type alloy, connecting ability of the block to the piston body 11 can be substantially improved.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A piston structure for an internal combustion engine which has a lubricant injection nozzle for injecting lubricant into a cylinder bore comprising:

a piston body having a lower skirt section;

means for defining a cut-out in a lower end portion of said skirt section for receiving said lubricant injection nozzle when said piston is in a position in the vicinity of bottom-dead-center;

means for providing reinforcement in said lower end portion around a circumferential portion of said cut-out for preventing failure of said piston structure due to a concentration of stress in a portion around said cut-out; and said reinforcement means comprising a fiber reinforced core provided solely in the portion of said skirt section in which said cut-out is defined.

2. A piston structure as set forth in claim 1, wherein said fiber reinforced core is integrated with remaining skirt section by way of internal chill.

3. A piston structure as set forth in claim 2, wherein said fiber reinforced core is formed of fiber reinforced aluminum type composition.

4. A piston structure as set forth in claim 3, wherein said fiber reinforced core is formed of alumina-silicate fiber composition.

5. A piston structure as set forth in claim 4, wherein said core is formed by aggregating alumina-silicate fiber composition in a predetermined bulk density and by preforming into a desired configuration.

6. A piston structure for an internal combustion engine which has a lubricant injection nozzle for injecting lubricant into a cylinder bore comprising:

a piston body having a lower skirt section;

means for defining a cut-out in a lower end portion of said skirt section for receiving said lubricant injection nozzle when said piston is in a position in the vicinity of bottom-dead-center;

means for providing reinforcement in said lower end portion around a circumferential portion of said cut-out for preventing failure of said piston structure due to a concentration of stress in a portion around said cut-out; and said reinforcement comprising a pre-formed block formed of a material having higher strength than a material forming a major part of said piston body.

7. A piston structure as set forth in claim 6, wherein said pre-formed block is formed of an Al-Cu alloy and the major part of said piston body is formed of Al-Si type alloy.

8. A piston structure as set forth in claim 7, wherein said pre-formed block is integrated with said major part of said piston body by way of internal chill.

9. A piston structure as set forth in claim 7, wherein said pre-formed block is integrated with said major part of said piston body by way of welding.

* * * * *